US006692082B2

(12) United States Patent
Wyser

(10) Patent No.: US 6,692,082 B2
(45) Date of Patent: Feb. 17, 2004

(54) SEPARATING AND SUPPORT ELEMENT FOR A TOOL HOLDER

(75) Inventor: Rene Max Wyser, Tenniken (CH)

(73) Assignee: Airtec AG, Zunzgen (CH)

( * ) Notice: Subject to any disclaimer, the term of this patent is extended or adjusted under 35 U.S.C. 154(b) by 0 days.

(21) Appl. No.: 10/151,766

(22) Filed: May 21, 2002

(65) Prior Publication Data

US 2002/0190569 A1 Dec. 19, 2002

(30) Foreign Application Priority Data

Jun. 16, 2001 (CH) ..... 1092/01

(51) Int. Cl.[7] ..... E21C 25/08
(52) U.S. Cl. ..... 299/39.4; 299/40.1; 172/554
(58) Field of Search ..... 299/36.1, 38.1, 299/39.1, 39.4, 39.7, 39.9, 40.1; 404/93, 94; 172/45, 552, 554; 241/187, 191, 193

(56) References Cited

U.S. PATENT DOCUMENTS

| | | | | |
|---|---|---|---|---|
| 1,291,129 A | * | 1/1919 | Price | 172/69 |
| 4,256,182 A | * | 3/1981 | Nething | 172/45 |
| 4,333,686 A | | 6/1982 | Arnswald | |
| 4,704,045 A | | 11/1987 | Taylor et al. | |
| 4,720,207 A | * | 1/1988 | Salani | 404/90 |
| 4,725,097 A | * | 2/1988 | Zelenka | 299/40.1 |
| 4,891,858 A | | 1/1990 | Wachter | |
| 4,895,309 A | * | 1/1990 | Fritz | 241/185.5 |
| 5,092,658 A | | 3/1992 | Smith | |
| 5,722,789 A | * | 3/1998 | Murray et al. | 404/90 |
| 6,099,080 A | * | 8/2000 | Hirashita et al. | 299/39.3 |

FOREIGN PATENT DOCUMENTS

| | | |
|---|---|---|
| CH | 687 445 A5 | 12/1996 |
| DE | 298 22 034 U1 | 2/1999 |

* cited by examiner

*Primary Examiner*—David Bagnell
*Assistant Examiner*—Daniel P Stephenson
(74) *Attorney, Agent, or Firm*—Marshall, Gerstein & Borun LLP

(57) ABSTRACT

A separating- and support element (20, 21) for milling drums (1) on milling machines for coarse, uneven surfaces of concrete or asphalt, or for the removal of street markings, in which in a tool holder (2), shafts (4) are positioned between two flanges (5) on a radius (x), and milling tools (3) mounted in a loosely rotatable manner are placed thereon. The number of the milling tools (3) to be used can be determined freely in accordance with the use and the size of the milling tools (3). On the shafts (4) and between the flanges (5), milling tools (3) and separating- and support elements (20, 21) are consequently mounted alternating in a freely determinable sequence. The separating- and support elements (20, 21) comprise the central tube (6), whereby the distance of the two middle points (a and a') corresponds to the radius (x).

6 Claims, 7 Drawing Sheets

SEPARATING AND SUPPORT ELEMENT FOR A TOOL HOLDER

FIELD OF THE INVENTION

Figure 1:
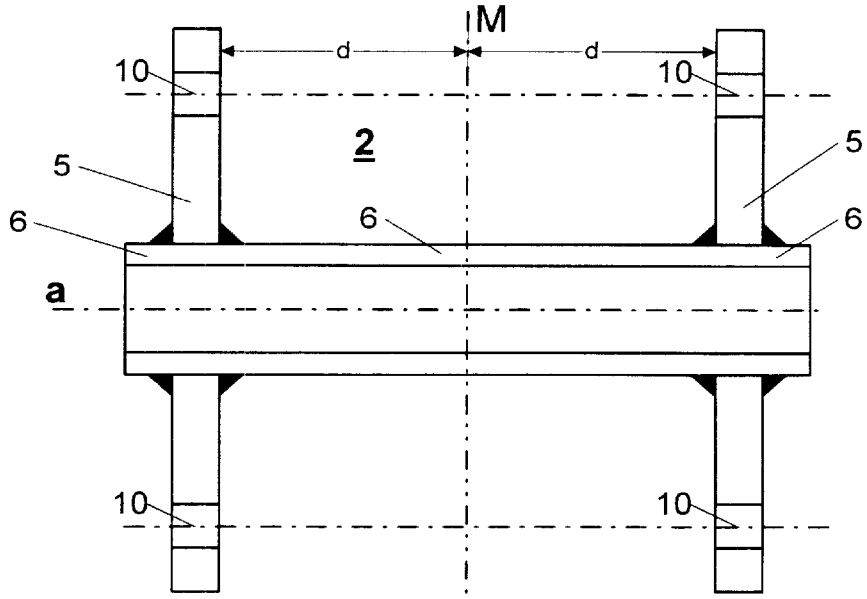

The present invention relates to a separating-and support element for a tool holder for a surface milling machine.

BACKGROUND OF THE INVENTION

Surface milling machines are used for the removal of rubber on runways and of road markings, and for the removal of surface coverings. The Swiss patent no. CH 687 445, by way of example, presents a surface milling machine of a small type. The actual tool holder is mostly constructed as a thread spool, to the flanges of which from two to eight shafts proceeding peripherally and in parallel to the core are generally attached, to which tools, such as small milling wheels, for example, can be mounted in a loose and rotatable manner. If the tool holder rotates, then the tools are externally held to the shafts by means of centrifugal force. If this tool holder is, during the rotary movement, brought near to a surface, the plane of which is positioned in parallel to the axis of the tool holder, then these tools strike on the surface to be processed or, first of all, onto elevations which are possibly present. This impact brings them into a rotating movement. The surface is processed with the force that is to be applied in order to overcome the inertia of the stationary tools. Irregularities are evened out and/or a thin layer of the surface is abraded away.

This impact-like stressing acts on the tools, shafts, tool holder, and drive unit of the surface milling machine. The more that this stressing is absorbed by suitable means, such as tools, shafts, and flanges of the tool holder, the less is the wear on the supports of the drive elements of the milling machine.

In order to additionally cushion the wear on the shafts, the shafts are supported on both of the flanges in a loosely rotatable manner. Frontal covers or other attachment means hold the shafts inside the flanges in which they are supported. The patent no. CH 1998 0067/98 proposes a tool holder of this type. Wear appears on both the tools and the shafts, as well as on the borings in the flanges in which the shafts are held.

In order, in the case of very hard applications, to support the shafts on the periphery of the flanges on which the tools are held, additional intermediate flanges are applied to the central tube, for example, as separating- and support elements. The shafts are thereby reinforced, and their service life is extended. The disadvantage that the positions of the tools on the shafts are predetermined by the flanges acting as separating- and support elements has to be accepted in return, however. If such a surface milling device is, during the milling, guided directly up to a surface, it leaves unprocessed corrugations behind at that point where the intermediate flanges are located. These intermediate flanges, by means of which better wear characteristics can be achieved, have the disadvantage that they act as separating- and support elements and no longer uniformly process the surface over the entire width of the tool holder. Such intermediate flanges are depicted, for example, in patent no. CH 687 445.

This fact is taken into account in other constructions through the fact that separating and support elements are, as so-called flange segments which each support one or more shafts, but not all shafts, however, are welded onto the central tube. These are positioned displaced along the length of the tool holder. By means of these flange segments, the disadvantage of the formation of corrugations is, to be sure, eliminated and the surface processed can be processed uniformly over the entire length of the tool holder, but dynamic disadvantages have to be accepted in return. Such types of tool holders provided with flange segments as separating- and support element must be balanced, since dynamic imbalances otherwise act on the support in a manner that promotes wear.

One additional disadvantage of these separating- and support elements (flange segments) welded solidly to the central tube is the predetermined fixed arrangement in which the tools must be mounted to the shafts. That is to say, it would be desirable for the user if, for individual applications, one pair, or three or more tools, could be mounted in succession one after another.

For applications with special tools, it is worthwhile to use few tools. This is also possible, in the tool holders with separating- and support elements described above, by means of intermediate disks between the tools and between the tools and flanges. In any event, possibilities are geometrically present. If neither intermediate flanges nor flange segments are present, then only a few tools can still be mounted by means of intermediate disks. In that case—because of the large unsupported lengths that arise on the shafts, and the imbalances that always arise—very great force peaks act on individual points of the shafts, and the wear is enormous. Even if separating- and support elements are present in the form of intermediate flanges and/or flange segments, the forces of the dynamic imbalances act on the shafts and support in a highly destructive manner.

The present invention now sets the task of improving the separating- and support elements for a tool holder of the type mentioned above in such a manner that, even if only individual tools are used, the dynamic imbalance of the tool holder still remains within acceptable limits, and the arrangement of the tools can be freely determined at the construction site each time in accordance with the requirements of the specific application.

SUMMARY OF THE INVENTION

Separating-and support elements for a tool holder with the characteristics of the present invention solve this task.

BACKGROUND DESCRIPTION OF THE DRAWINGS

Figure 2:
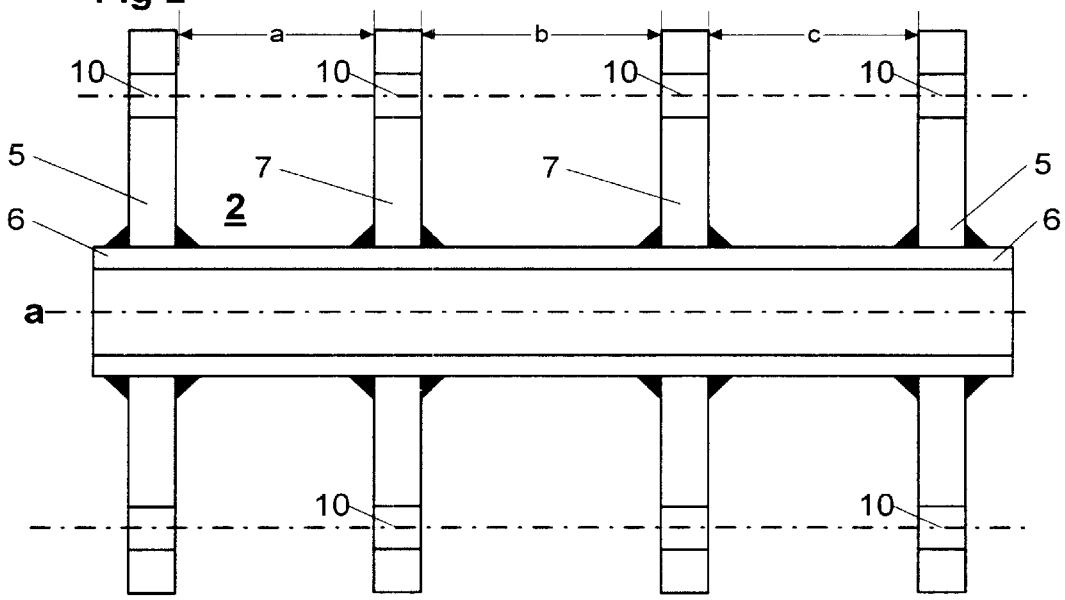
Figure 3:
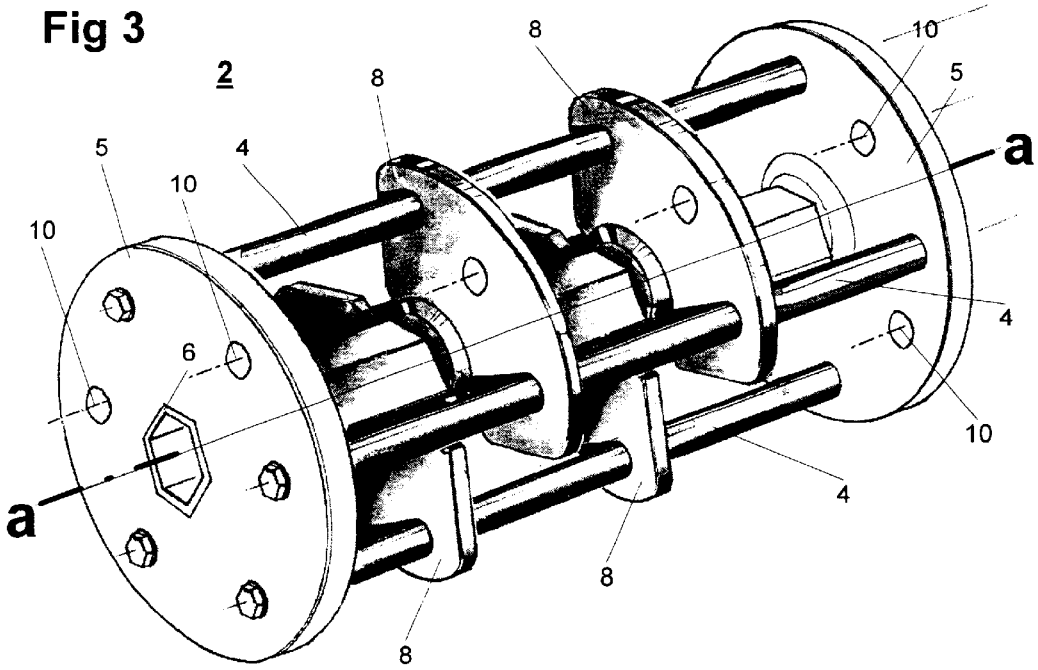
Figure 4:
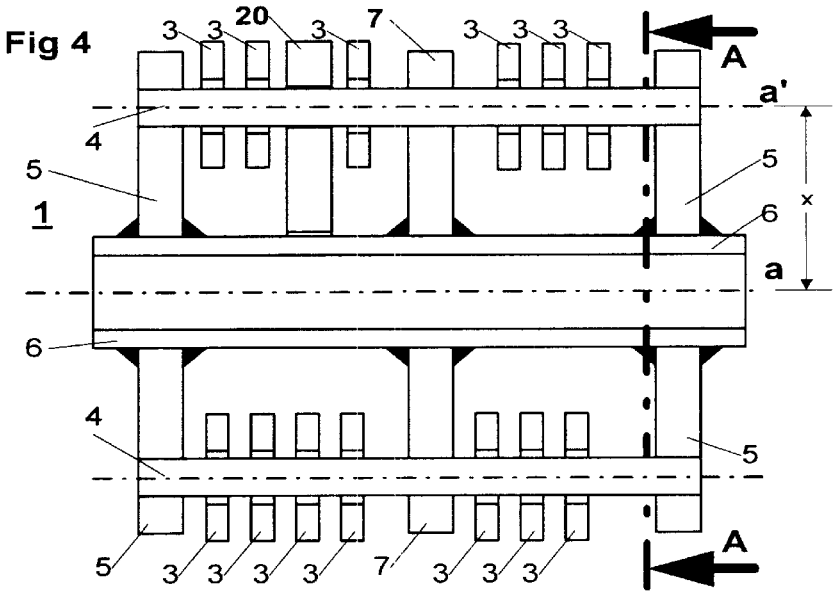
Figure 5:
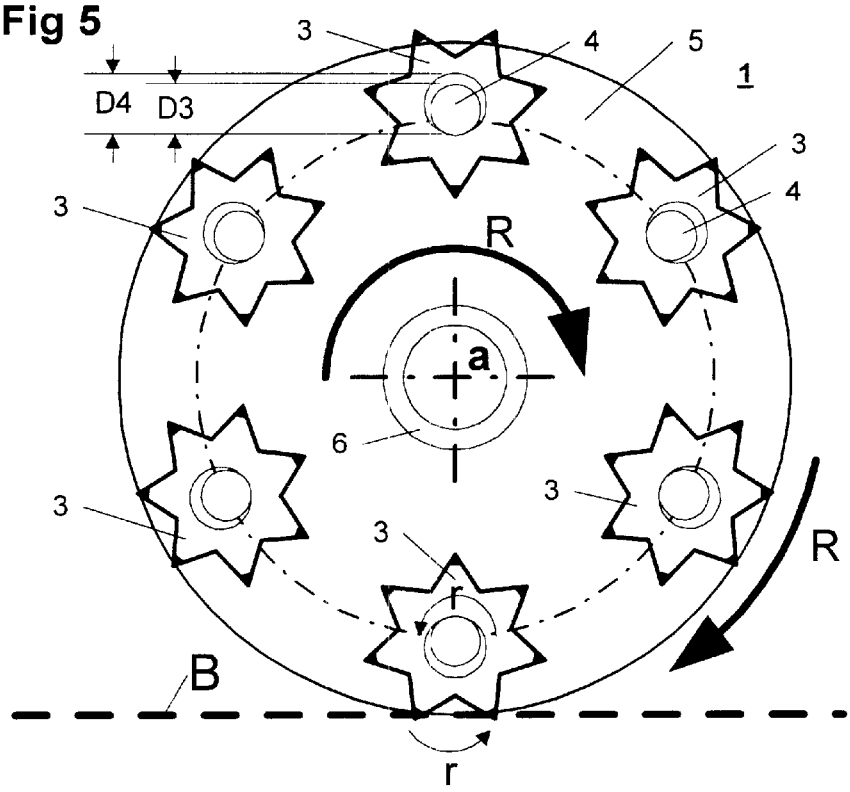
Figure 6:
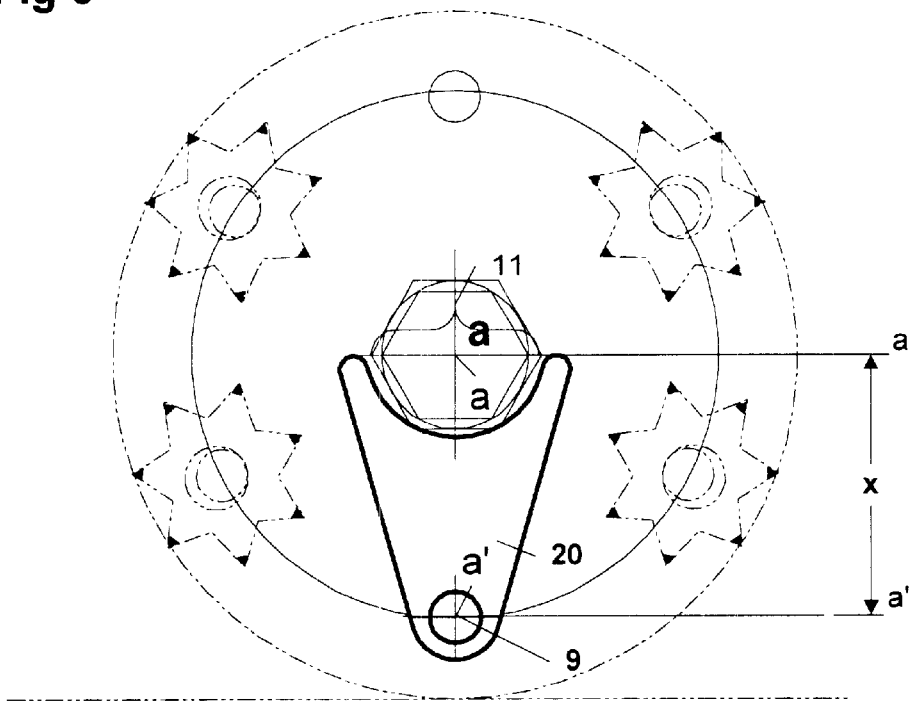
Figure 7:
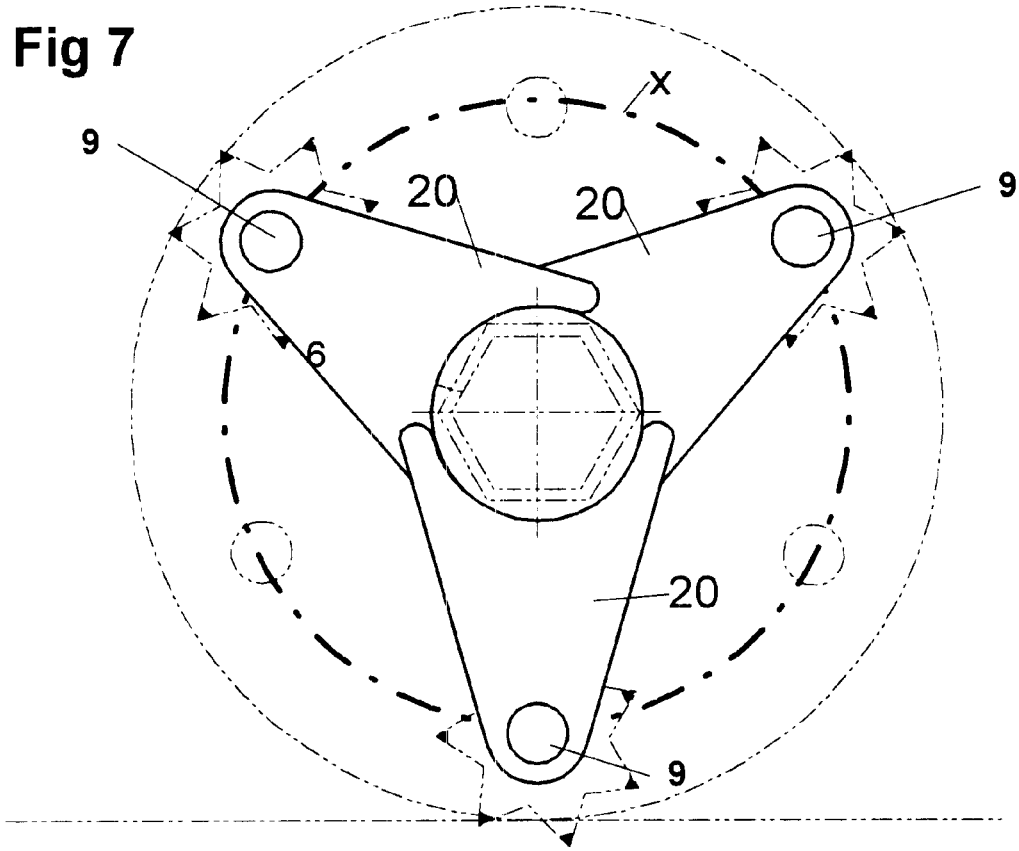
Figure 8:
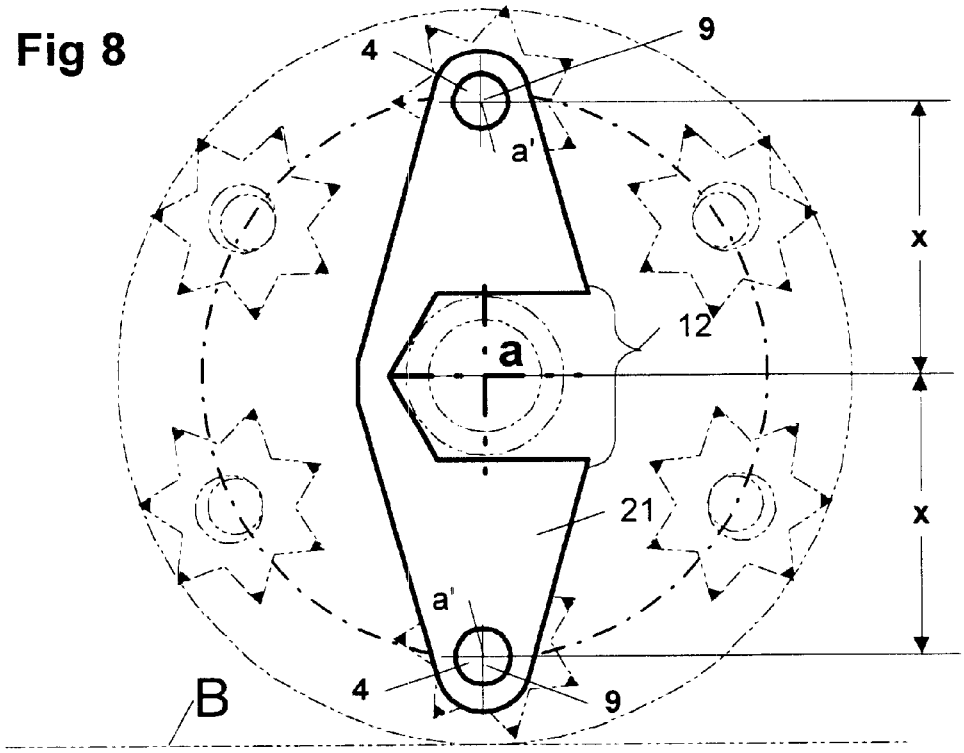
Figure 9:
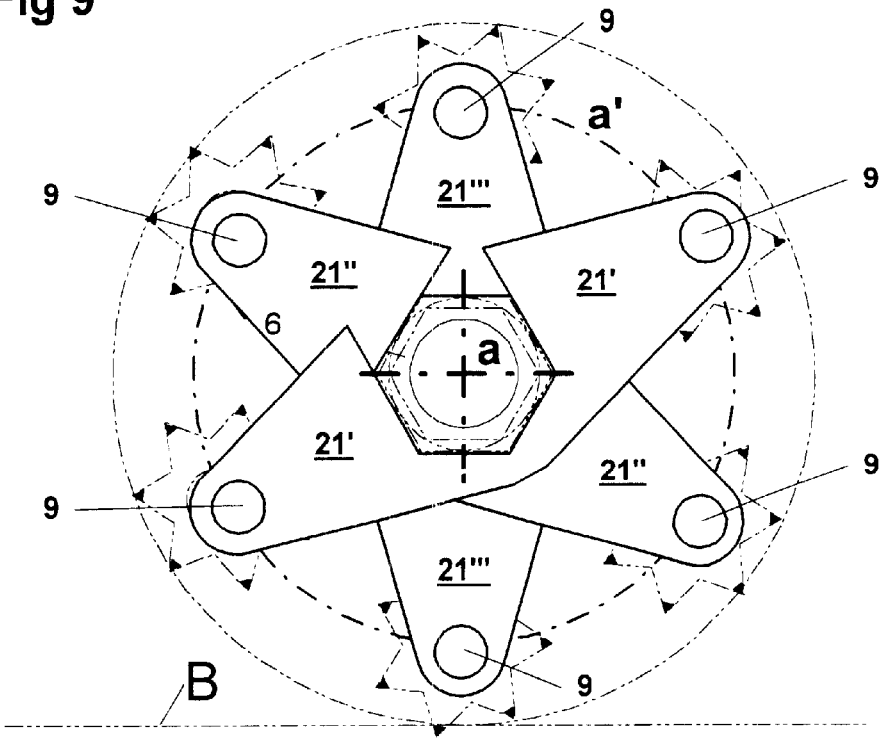
Figure 10:
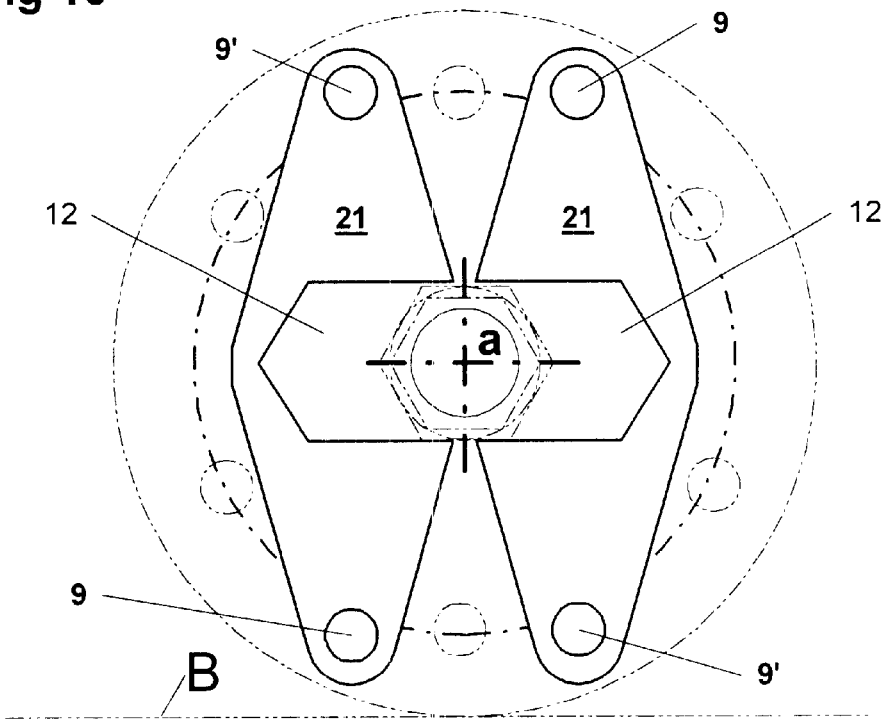
Figure 11:
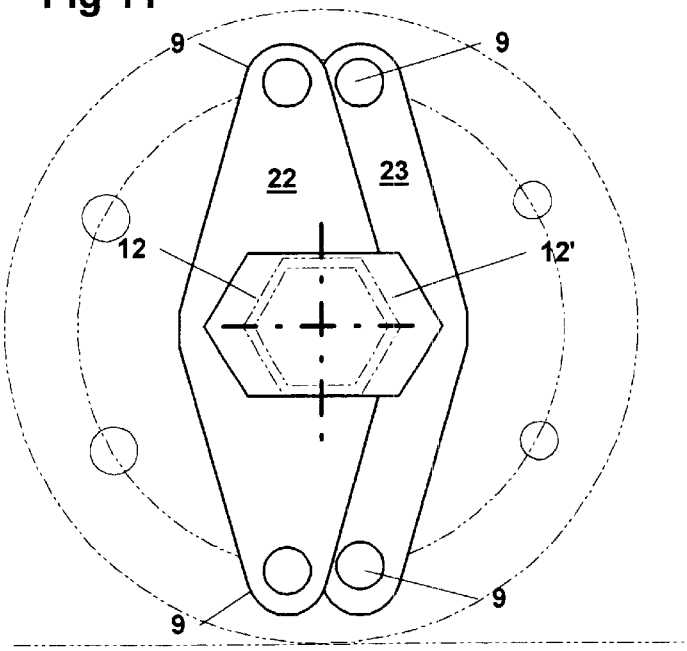
Figure 12:
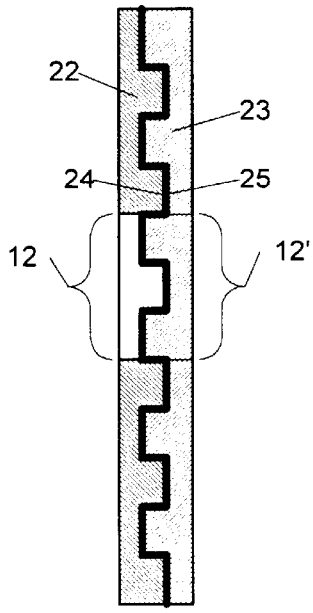

The drawings on the following pages depict the following:

FIG. 1: Tool holder;

FIG. 2: Tool holder with separating- and support elements in the form of intermediate flanges;

FIG. 3: Tool holder with separating- and support elements in the form of flange segments;

FIG. 4: A section of a milling drum with intermediate flanges;

FIG. 5: The section A—A of a milling drum equipped with tools;

FIG. 6: Tool holder with simple separating- and support element;

FIG. 7: Tool holder with three simple separating- and support elements;

FIG. 8: Tool holder with double separating- and support element;

FIG. 9: Tool holder with three double separating- and support elements;

FIG. 10: Tool holder with reinforced double separating- and support element;

FIG. 11: View of a double separating- and support element;

FIG. 12: Section of a double separating- and support element.

DETAILED DESCRIPTION OF THE INVENTION

The figures depict preferred examples of implementation, which are illustrated by the following description.

The tool holders (2) as depicted in FIG. 1 are a solid welding construction consisting of a central tube (6) and two flanges (5) solidly welded to its ends. The central tube (6) can have a circular, a hexagonal, or another polygonal tube profile. For the accommodation of the shafts (4) on a circle with radius (x), borings (10) for the accommodation of the same are provided in the flanges (5). As depicted in FIG. 4, the tools (3) are mounted on these shafts (4) and thus form a milling drum (1). Such milling drums (1) are used for the leveling of concrete- and asphalt surfaces. These machines are frequently also used for the removal of street markings and rubber residues from tires on airport runways.

In conventional milling drums (1), for example, six shafts (4) are used. In order to extend the service life of the tool holder (2), three shafts (4) uniformly distributed over the circumference are then used. The borings (10) on the flanges are, during the course of use, extended in such a manner that they can no longer guide the shafts (4) after a certain time. Therefore, with six possible shafts (4), work is only carried out with three, so that the three non-damaged borings (10) are used for a second application. During the use of a multiplicity of shafts (4) for the milling drum (1), an even number of shafts (4) is correspondingly used. The possibility of using only half of the shafts (4) is thereby provided, and a longer service life for the tool holder (2) is thereby achieved.

In order to be able to freely position the milling tools (3) (FIGS. 4, 5) and to thereby support the shafts (4) accurately, intermediate flanges (7), for example, are also welded in. Such constructions have the disadvantage that the surface can not be made even during a passage over the width of the milling drum (1). Elevations arise at the place of every intermediate flange, because no milling tool (3) processes the surface at these points.

In order to avoid the creation of such corrugations, there are constructions that provide flange segments (8) on the central tube (6) (FIG. 3). It is thereby brought about that certain shafts (4) can be equipped with milling tools (3) at that point where other shafts (4) are held by the flange segments (8) and can not accommodate any milling tools (3).

The milling tools (3) are mounted on the shafts (4) with a large clearance (difference between D4 and D3, FIG. 5) so that they can thereby move freely. Through the rotation of the milling drum (1) in the direction "R", the milling tools (3) are, through contact with the surface "B", displaced into an opposite rotational direction "r". Since they are not moved relative to the shaft (4) before this contact, this "impact" causes the processing of the surface "B", triggered by the inertial energy stored in the milling tools (3).

In order to achieve a processing of the surfaces (B) that is as uniform as possible, the milling tools (3) (FIG. 5) should be positioned evenly on the circumference and in the axial direction. Because of the installation of the intermediate flanges (7) (FIGS. 2, 4), this is not brought about, for the reasons stated. The use of flange segments (8), on the other hand, entails the danger and the problem that the milling drum is not evenly stressed in dynamic terms, and tends towards imbalance.

Separating- and support elements (20 and 21) of the type stated above are always used for a tool holder (2) which consists of two flanges (5) and a central tube (6) (FIG. 1). The use of a simple separating- and support element (20) as depicted in FIG. 6 offers the advantage that the distances (a, b, and c) (FIG. 2) for the milling tools (3) can be adjusted to the specific requirements. The simple separating- and support element (20) is slid onto one of the shafts (4). It can be moved freely back and forth in the axial direction between the two flanges (5). By that means, on each of the shafts (4), milling tools (3) and separating- and support elements (20 and 21) can alternate within a large range of desired sequence.

In order to also take the dynamic imbalance into account, a set consisting of three simple separating- and support elements is mounted as depicted in FIG. 7, for example. The application of two such sets of separating- and support elements, which are positioned symmetrically to the center (M) between the flanges (5) (FIG. 1) of the tool holder, bring about the best result of a dynamic nature.

These simple separating- and support elements offer the possibility of the separation of sections between the milling tools (3) on the shafts (4) and, at the same time, support the shafts (4) against the impacts acting in the direction of the central tube (6) during use. The arrangement of the milling tools (3) can be ideally adjusted to the application.

A double separating- and support element (21) can be used to improve the dynamic characteristics, but also the supporting effect of such an element both against the impacts as well as against the effect of the centrifugal force on the shafts (4). Two shafts (4) positioned opposite one another are connected with this double separating- and support element. Two shafts (4) are guided through the borings (9 and 9'). At the same time, the double separating and support element (21) is supported on the recess (12) on the central tube (6).

It is conceivable and advantageous that two double separating- and support elements (21) are used as depicted in FIG. 10. In the mounted condition, these encircle the central tube (6) by 360°. If these two double separating- and support elements are then additionally connected by making them into a supporting part, such as by means of screws, for example, then a good reinforcement of the shafts (4) is achieved.

It is brought about, through the double separating- and support elements positioned symmetrically around the central tube (6), that no imbalances arise. Simple and double separating- and support elements can be used on a milling drum (1), together with the milling tools (3), in free succession on the shafts (4).

In order to use two double separating- and support elements (22, 23) in a supporting part with as little expansion in the axial direction of the shaft (4) as possible, these can be assembled, as depicted in FIG. 12, by means of corresponding contours. Such an element, being held with screws, forms a very stabile connection between the shafts (4) and can nevertheless be displaced in the axial direction in such a manner that milling tools (3) can be positioned as desired. Such devices considerably extend the service life of a milling drum and therefore also offer, in addition to the advantage of being able to use milling tools (3) at any point desired, the advantage of greater economy.

The possibilities for assembly and mounting are depicted schematically in the diagrams. Such devices have already been very successful during tests.

I claim:

1. A separating- and support element (20, 21) for milling drums (1) on milling machines for coarse, uneven surfaces of concrete or asphalt or for the removal of street markings, comprising milling drums (1) having a tool holder (2), between the flanges (5) of which shafts (4) are positioned on a radius (x), onto which shafts the milling tools (3) which are mounted in a loosely rotatable manner are slid, whereby the number of milling tools (3) used can be freely determined in accordance with the use and the size of the milling tools (3), the milling tools (3) and separating- and support elements (20, 21) are mounted in the axial direction at any chosen point on the shafts (4) and between the flanges (5), alternating in a sequence that can be freely determined, whereby the separating- and support elements (20, 21) have a semicircular recess (11, 12) comprising a maximum of 180°, with the diameter of the central tube (6) determining the outermost contours of the profile, whereby the distance between the center (a) of the central tube (6) and the center (a') of the boring (9) corresponds to the radius (x), and whereby the borings (9) serve for the accommodation of the shafts (4), the separating- and support element (20) encircles the central tube (6) with an opening (11) on one side by a maximum of 180°, and a double separating- and support element (21) is slid onto two shafts (4, 4') and has on the side, at an angle of 90° from the connecting line between the centers of the shafts (4 and 4'), a recess (11) which proceeds around the central tube (6) on the side with a maximum of 180°.

2. A separating- and supporting element in accordance with claim 1, wherein the recesses (11, 12) encircle the central tube (6) on its radially-positioned outermost profile contours.

3. A separating- and support element in accordance with claim 2 wherein the tube profile of the central tube (6) is selected from one of circular, hexagonal, and polygonal.

4. A separating- and support element in accordance with claim 1, wherein the double separating- and support element (21) consists of a left part (22) and of a right part (23), whereby the recesses (12, 12') provided for the central tube (6) are positioned diametrically opposite to one another.

5. A separating- and support element in accordance with claim 1 or 4, wherein the recesses (12, 12') of one double pair of separating- and support elements (22, 23) have in common a recess (12, 12') comprising 360°.

6. A separating- and support element in accordance with claim 1 or 4, wherein the left part (22) and the right part (23) of one pair of double support elements (22, 23) have contours (24, 25) by means of which, in the assembled condition, they form a form-locking and force-locking connection in the direction of the connecting line of the two borings (9, 9').

* * * * *